US005553763A

United States Patent [19]

Ring

[11] Patent Number: 5,553,763

[45] Date of Patent: Sep. 10, 1996

[54] FEEDING OF OFFSET, COLLATED FORMS

[75] Inventor: Robert S. Ring, Rochester, N.H.

[73] Assignee: Moore Business Forms, Inc., Grand Island, N.Y.

[21] Appl. No.: 378,829

[22] Filed: Jan. 27, 1995

Related U.S. Application Data

[62] Division of Ser. No. 127,380, Sep. 28, 1993, Pat. No. 5,417,360.

[51] Int. Cl.[6] ..... B26F 3/02; B65H 20/02

[52] U.S. Cl. ..... 225/4; 225/100; 226/1; 226/102; 226/171; 226/182; 226/193

[58] Field of Search ..... 225/4, 93, 100; 83/47, 301, 302; 226/102, 171, 181, 182, 193

[56] References Cited

U.S. PATENT DOCUMENTS

| | | | |
|---|---|---|---|
| 4,069,957 | 1/1978 | Moffitt | 225/100 X |
| 4,118,022 | 10/1978 | Rayfield et al. | 225/100 X |
| 4,261,497 | 4/1981 | Roetter et al. | 225/100 |
| 4,851,075 | 7/1989 | Parker | 225/100 X |
| 4,889,271 | 12/1989 | Kurokawa | 226/193 X |
| 5,060,838 | 10/1991 | Gergely et al. | 225/100 |

*Primary Examiner*—Rinaldi I. Rada
*Assistant Examiner*—Raymond D. Woods
*Attorney, Agent, or Firm*—Nixon & Vanderhye P.C.

[57] ABSTRACT

During the feeding of offset continuous collated business form webs to the slow rollers of a burster, it is important to insure that the top web properly passes through the slow roll section. By providing a number of puller wheels having aluminum cores and sawtooth rubber coverings atop conveyor belts passing over crowned pulleys which are overspeed relative to the web speed, proper feed to the burster is provided. Form deflecting fingers extending from the puller wheels to the burster also help. In order to prevent the conveyor belts from running off the crowned pulleys an aligner is provided which has a number of vertical dowel pins with plastic sleeves covering and rotatable with respect to the dowel pins, disposed on each side of a conveyor belt associated with a crowned pulley and puller wheel. The aligner is provided immediately upstream of a rubber covered drive roll for the conveyor belts.

16 Claims, 4 Drawing Sheets

FEEDING OF OFFSET, COLLATED FORMS

This is a divisional of application Ser. No. 08/127,380, filed Sep. 28, 1993, now U.S. Pat. No. 5,417,360.

BACKGROUND AND SUMMARY OF THE INVENTION

Some modern business form bursters, such as disclosed in copending applications Ser. No. 08/020,537 filed Feb. 22, 1993 (Atty Ref. 263-849, 92-38) and Ser. No. 08/123,971 filed Sep. 21, 1993, (Atty Ref. 263-901, 92-40), are utilized to burst mid-form slit and collated business forms. These business forms, because of the mid-form slitting and 50% offset of leading edges of each web (two or more webs one on top of the other are provided) present a problem with regard to proper feeding to the burster. Oftentimes the top web does not feed properly through the slow roll section of the burster, resulting in poor operation, torn webs, or other adverse consequences.

In order to correct the problem discussed above, according to the present invention a plurality of puller wheels are associated with the conveyor belts which transport the offset continuous collated business forms to the burster. The puller wheels are mounted atop some of the conveyor belts at the point which those conveyor belts pass over crowned pulleys, the conveyor belts driven by a powered rubber covered transport roll upstream of the crowned pulleys. An apertured rigid plate also is provided above the conveyor belts and pulleys, with the puller wheels' external surfaces extending through the apertures into contact with the forms. The puller wheels have a rigid (aluminum) core and a resilient material (rubber) covering that has a sawtooth configuration, so that the puller wheels may be oversped relative to the business form speed without causing excessive pull on the webs themselves. In this way offset collated forms are properly fed to the slow rolls of a burster having slow roll and fast roll sections.

The puller wheels may cause the conveyor belts to run off the crowned pulleys. In order to preclude this, a conveyor belt aligner is provided. The conveyor belt aligner includes an idler roller disposed on each side of each conveyor belt associated with a crowned pulley and pulley wheel. The idler rolls may be formed by metal dowel pins which extend generally vertically (perpendicular to the axis of the drive roller for the conveyor belts) and are covered by plastic sleeves which may rotate with respect to the dowel pins (are loose fitting). At least one of the dowel pins, with associated sleeve, may be provided between two conveyor belts, aligning both. All the dowel pins may be mounted on an aluminum bar which is positioned adjacent (e.g. just upstream of and below) the powered rubber covered transport roll.

Utilizing the apparatus described above, according to another aspect of the present invention a method of feeding offset continuous collated business form webs to a burster having slow rolls and fast rolls is provided. The method comprises the steps of: (a) Feeding the webs in a first direction at a first speed. (b) Engaging one of the webs with a plurality of puller wheels driven at a second speed greater than the first speed, in such a way that excessive pull of the web does not occur. And (c) directing the webs from the puller wheels directly to the burster so that all webs are reliably fed between the slow rolls of the burster.

Step (a) is typically practiced by conveyor belts which pass over crowned pulleys, and step (b) is practiced by providing a sawtooth resilient material covering the puller wheels. There is also the step (d) of positively preventing the conveyor belts from running off the crowned pulleys associated with the puller wheels, the step (d) being practiced by providing idler rollers on opposite sides of each of the conveyor belts associated with a crowned pulley with puller wheel.

It is a primary object of the present invention to effect the proper feeding of offset collated business forms to the slow roll section of a burster. This and other objects of the invention will become clear from an inspection of the detailed description of the invention, and from the appended claims.

DETAILED DESCRIPTION OF THE DRAWINGS

Figure 1:
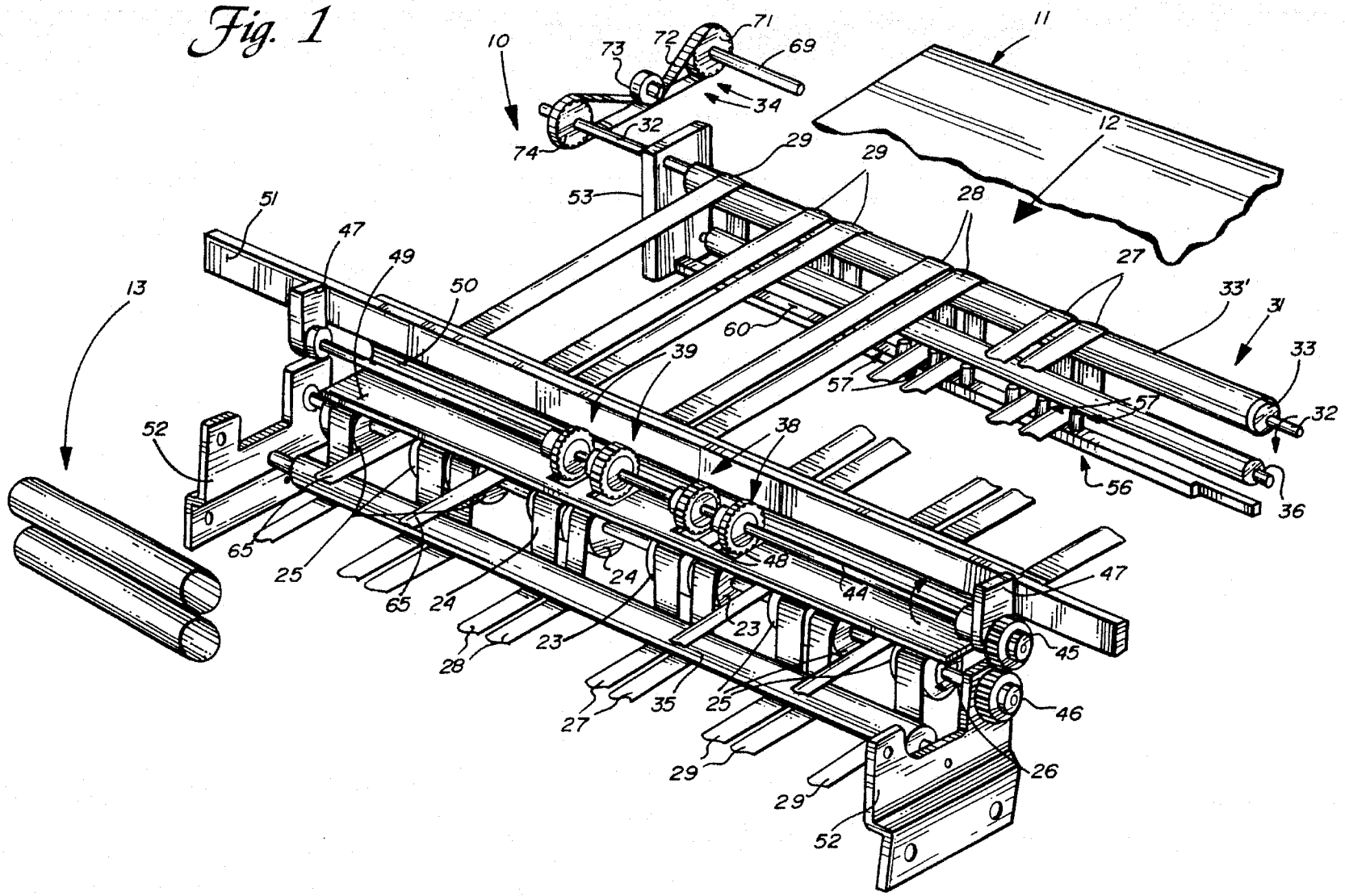
FIG. 1 is a top perspective view, with a number of components cut away for clarity of illustration, of exemplary apparatus for feeding business forms to a burster, according to the present invention.
Figure 2:
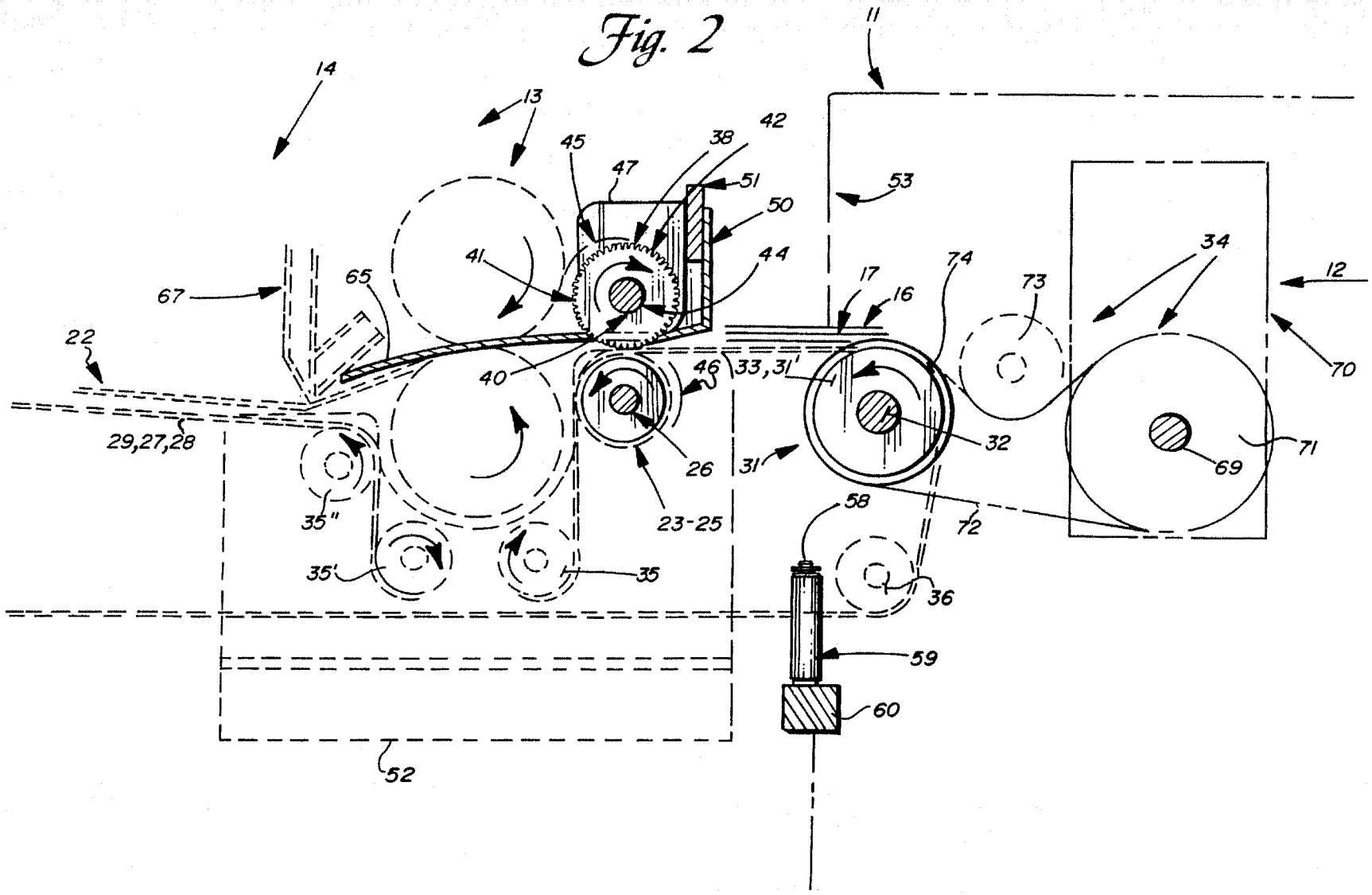
FIG. 2 is a detail schematic side view, primarily in elevation, of the apparatus of FIG. 1.
Figure 4:
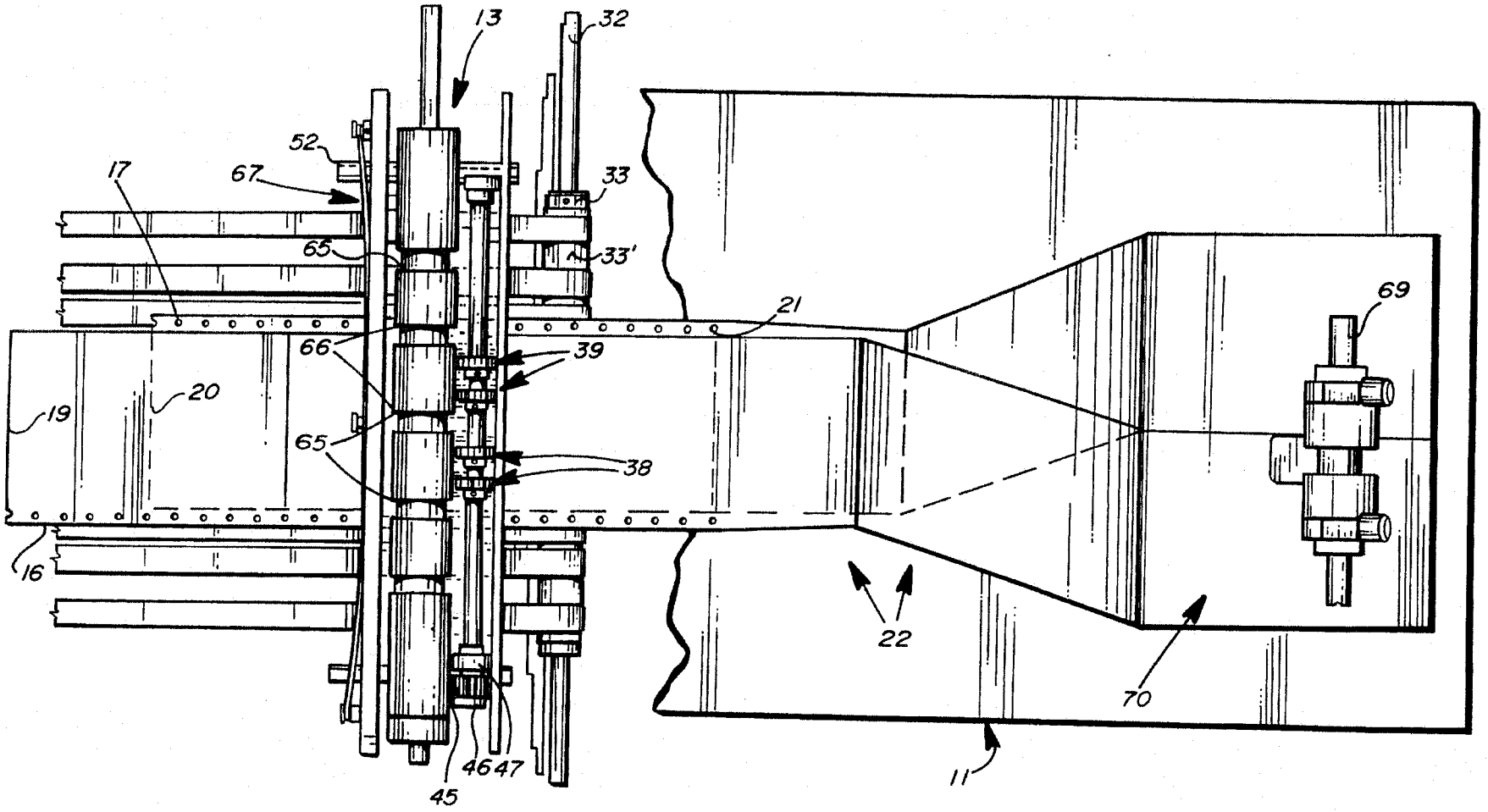
FIG. 4 is a top plan view of the apparatus of FIGS. 1 and 2, showing the mid form slitting.

The apparatus shown generally by reference numeral 10 in FIG. 1 is designed to feed offset continuous collated business form webs, from an in-feed area or machine 11, in a first direction 12, to the slow rolls of a burster, such as the burster disclosed in copending application Ser. No. 08/020,537 filed Feb. 22, 1993. A portion of the slow speed rolls (the rolls are cut off so as to clearly illustrate the components of the apparatus 10) are shown generally by reference numeral 13 in FIG. 1, and are associated with the burster shown schematically by reference 14 in FIG. 2. The apparatus 10 is specifically designed to insure that the top web of the business forms are properly fed to the slow rollers 13, which can be a problem due to the mid-form slitting and 50% offset of leading edges of each web of the form. In particular see FIG. 2 which shows a top web 16 and bottom web 17 formed by mid form slitting, having offset perforations 19, 20, respectively, and collated so that they are one on top of the other as illustrated in FIGS. 2 and 4. The forms—shown generally by reference numeral 22—are supplied from a business supply area or machine 11, also shown only schematically in FIGS. 1, 2, and 4.

The apparatus 10 according to the invention includes a plurality of crowned idler pulleys, for example, the pulleys 23, the pulleys 24, and the pulleys 25 which are rotatable about a first axis (typically horizontal) defined by a first, idler, shaft 26. An endless conveyer belt (conveyer tape) passes over each of the crowned pulleys 23–25, a total of ten such conveyer tapes 27–29 being provided in the exemplary embodiment illustrated in the drawings. For example, the conveyer belts 27 pass over the pulleys 23, the belts 28 pass over the pulleys 24, and the belts 29 pass over the pulleys 25. The business forms 22 are conveyed on the tops of the belts 27 through 29 in direction 12 from the in-feed (business form supply) 11 to the burster 14.

Means are provided for driving the conveyer belts 27 through 29. Such means preferably takes the form of the powered transport roll 31 illustrated in FIG. 1, which comprises a shaft 32 with a tube 33 surrounding it, in turn having a rubber covering 33', and driven by the drive apparatus 34 (see FIGS. 1 and 2, and described more fully below). Various other idler rollers are also associated with the belts 27–29 to properly direct them in their conveying paths, for example, the idler assemblies 35, 35', 35" located just in front of and below the pulleys 23–25 (see FIGS. 1 and 2), and the idler assembly 36 located just below the transport roller 31.

According to the present invention, in order to insure that all webs of the business forms 22, including the top web 16, are properly fed to the rollers 13 of the burster 14, puller wheels are provided associated with at least some of the crowned pulleys. In FIG. 1, the puller wheels 38 are shown associated with the crowned pulleys 23 and the belts 27, while the puller wheels 39 are shown associated with the pulleys 24 and the belts 28. Each of the puller wheels 38, 39 preferably has a rigid material (e.g. aluminum) core 40 (see FIG. 2 in particular), with a covering 41 of resilient material. Preferably the covering 41 is natural or synthetic rubber, and has a sawtooth peripheral configuration, as indicated generally by reference numeral 42 in FIG. 2. By providing this particular construction the puller wheels 38, 39 can be oversped with respect to the forms 22 moving in the direction 12 without providing an excess of pull on the paper of the webs 16 and 17.

The puller wheels 38, 39 are mounted for rotation about an axis which is parallel to, and preferably vertically aligned with, the axis defined by the shaft 26. Defining the axis about which the puller wheels 38, 39 are rotatable is preferably the second shaft 44, which is driven by gear 45 that meshes with gear 46 that is attached to shaft 26. The shaft 26 is rotated by the action of the belts 27–29 as they pass over and around pulleys 23–25. The shafts 44, 26 are in a common substantially vertical plane, as seen in FIGS. 1 and 2. Shaft 44 is mounted in end blocks 47 that are secured to bar 51.

The puller wheels 38, 39 are preferably positioned to extend through apertures 48 in a rigid plate 49 mounted just above the webs 22 and the conveyor belts 27–29. The rigid plate 49, of steel, aluminum, or the like, preferably is part of an L-shaped component having a vertical leg 50, which may be welded or otherwise attached to a support bar 51 which is connected to a frame for the apparatus 10, the frame also comprising the end plates 52 for mounting the shaft 26, idler assemblies 35, 35', 35", etc. The end plate 53, part of machine 11, is for mounting the shaft 32 and the idler assembly 36.

While the apparatus 10 heretofore described is effective to insure proper feeding of the two webs 16, 17 to the slow rolls 13 of the burster 14, when the puller wheels 38, 39 are provided, because the pulleys 23, 24 are crowned (as is illustrated in FIG. 2), the conveyor belts 27, 28 associated with the pulleys 23, 24 have a tendency to run off the pulleys 23, 24. In order to avoid this undesirable result, means are provided for preventing the conveyor belts 27, 28 associated with the puller wheels 38, 39 from running off the crowned pulleys 23, 24. Such means are illustrated generally by reference 56 in FIGS. 1 and 3, and take the form of idler rollers, illustrated generally by reference numerals 57, disposed on each side of each conveyor belt 27, 28.

Figure 3:
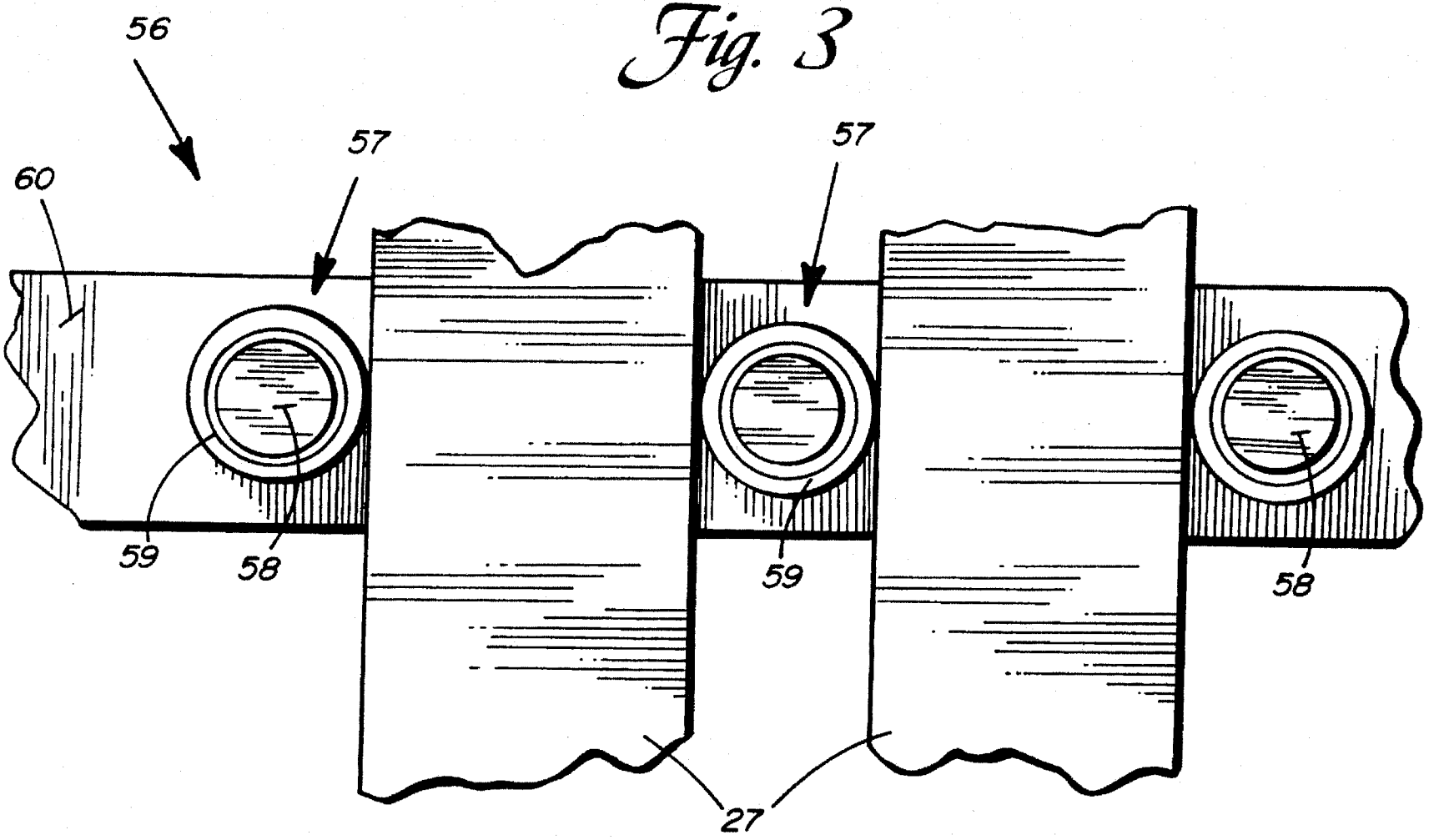
FIG. 3 is a detail top view of a portion of the conveyor belt aligner mechanism of the apparatus of FIG. 1.

As can be seen in FIG. 3, each of the idler rollers 57 preferably comprises a substantially vertical dowel pin 58, of steel or the like, which is surrounded by an elongated sleeve 59, (i.e. having a length much greater than the thickness of the belt 17, 28 with which it is associated). The elongated sleeve 59, typically of hard plastic, has a relatively loose fit with the pin 58 so that it can rotate with respect to the pin 58 if impacted by the edges of a conveyor belt 27, 28.

As seen in both FIGS. 1 and 3, preferably all of the pins 58 are mounted on an aluminum bar 60 which is stationary (e.g. mounted on stationary plates 53 of the frame of machine 11), and the idler rollers 57 are provided so that one idler roller—the middle one as illustrated in FIG. 3 is between the pair of belts 27 the elongated sleeve 59 thereof having an outside diameter which is the same as or slightly less than the desired spacing between the belts 27.

It is particularly effective to mount the mechanism 56 where illustrated in FIG. 1, that is adjacent the drive roll 31 for the conveyor belts 27–29. By providing the idler rollers 57 just upstream of the drive roll 32 (just prior to the idler assembly 36), it is insured that the belts 27, 28 are properly aligned just prior to being driven.

In the exemplary embodiment illustrated in FIG. 1, four puller wheels 38, 39 are provided, associated with four crowned pulleys 23, 24, with six additional pulleys 25, and conveyor belts 29 associated therewith, that do not cooperate with puller wheels. However, any number of puller wheels, conveyor belts, and the like can be provided, although all that is necessary for the ten conveyor belt (27–29) embodiment of FIG. 1 is to provide four puller wheels associated with the center-most conveyor belts 27, 28.

As seen in FIGS. 1, 2 and 4, the apparatus may also utilize form deflection fingers 65 to properly guide the forms to the burster 14, the fingers 65 received in grooves 66 in the rollers 13 (see FIG. 4). The fingers 65 desirably terminate just short of a conventional breaker blade (shown in dotted line at 67 in FIG. 2) of the conventional burster 14.

The drive mechanism 34 may include a shaft 69 from slitters, shown schematically at 70 in FIGS. 3 and 4. The slitters 70 are shown out of position in FIG. 4 for clarity of illustration, FIG. 4 schematically showing a mid form slitting procedure. The shaft 69 drives pulley 71, connected by a timing belt 72 through idler 73 to a pulley 74 associated with shaft 32.

In use of the apparatus 10 according to the invention, business forms 22 are fed from the machine 11 in the direction 12, being transported by the belts 27–29 being driven by the rotating transport roll 31. The forms 22 pass underneath the plate 49 over the crowned idler pulleys 23–25, and portions thereof are engaged by the puller wheels 38, 39 being rotated by gear 45 through gear 46 at a speed slightly greater than the speed of the conveyor belts 27–29 (and forms 22 conveyed thereby). The puller wheels 38, 39, and form deflecting fingers 65, insure that the forms 22, even though they are offset and collated with mid slits, are reliably fed to the slow rolls 13 of the burster 14, the business forms 22 being acted upon in the burster 14 to separate the various webs 16, 17 at their perforations 19, 20. During this action, the belts 27, 28 move between the idler rolls 57 which are rotatable about axes perpendicular to the axis of rotation of the transport roll 31 for the belts 27, 28, so that the belts 27, 28 do not run off the pulleys 23, 24.

While the invention has been herein shown and described in what is presently conceived to be the most practical and preferred embodiment thereof, it will be apparent to those of ordinary skill in the art that many modifications may be made within the scope of the invention, which scope is to be accorded the broadest interpretation of the appended claims so as to encompass all equivalent structures and methods.

What is claimed is:

1. A method of feeding offset continuous collated business form webs to a burster having slow rolls and fast rolls, each business form web including top and bottom webs, comprising the steps of:

(a) feeding the top and bottom webs together in a first direction at a first speed;

(b) engaging one of the top and bottom webs with a plurality of puller wheels, distinct from the slow rolls and fast rolls of the burster, driven at a second speed greater than the first speed, in such a way that excessive pull of the one web does not occur; and (c) directing the webs from the puller wheels directly to the burster so that all webs are reliably fed between the slow rolls of the burster.

2. A method as recited in claim 1 wherein step (a) is practiced by transporting the webs on conveyor belts spaced from each other in a second direction perpendicular to the first direction, the conveyor belts passing over crowned pulleys; and wherein step (b) is practiced by providing the puller wheels with sawtooth configuration resilient material external peripheries, and mounting the puller wheels directly over some of the crowned pulleys and the conveyor belts passing thereover.

3. A method as recited in claim 2 comprising the further step (d) of positively preventing the conveyor belts associated with the crowned pulleys from running off the crowned pulleys.

4. A method as recited in claim 3 wherein step (d) is practiced by causing the conveyor belts associated with the crowned pulleys and puller wheels to pass between idler rollers adjacent the sides of the conveyor belts.

5. A method as recited in claim 3 comprising the further step of mid form slitting to produce the webs prior to step (b).

6. A method as recited in claim 3 wherein step (c) is practiced in part by providing form deflecting fingers extending between the puller wheels and burster.

7. A method as recited in claim 2 comprising the further step of mid form slitting to produce the webs prior to step (b).

8. A method as recited in claim 2 wherein step (c) is practiced in part by providing form deflecting fingers extending between the puller wheels and burster.

9. A method as recited in claim 1 comprising the further step of mid form slitting to produce the webs prior to step (b).

10. A method as recited in claim 9 wherein step (c) is practiced in part by providing form deflecting fingers extending between the puller wheels and burster.

11. A method as recited in claim 1 wherein step (c) is practiced in part by providing form deflecting fingers extending between the puller wheels and burster.

12. A method of feeding offset continuous collated business form webs to a burster having slow rolls and fast rolls, comprising the steps of:

(a) feeding the webs in a first direction at a first speed;

(b) engaging one of the webs with a plurality of puller wheels driven at a second speed greater than the first speed, in such a way that excessive pull of the one web does not occur; and (c) directing the webs from the puller wheels directly to the burster so that all webs are reliably fed between the slow rolls of the burster; and wherein step (a) is practiced by transporting the webs on conveyor belts spaced from each other in a second direction perpendicular to the first direction, the conveyor belts passing over crowned pulleys; and wherein step (b) is practiced by providing the puller wheels with sawtooth configuration resilient material external peripheries, and mounting the puller wheels directly over some of the crowned pulleys and the conveyor belts passing thereover.

13. A method as recited in claim 12 comprising the further step (d) of positively preventing the conveyor belts associated with the crowned pulleys from running off the crowned pulleys.

14. A method as recited in claim 13 wherein step (d) is practiced by causing the conveyor belts associated with the crowned pulleys and puller wheels to pass between idler rollers adjacent the sides of the conveyor belts.

15. A method as recited in claim 12 comprising the further step of mid form slitting to produce the webs prior to step (b).

16. A method as recited in claim 12 wherein step (c) is practiced in part by providing form deflecting fingers extending between the puller wheels and burster.

* * * * *